US005305801A

United States Patent [19]

Rupflin et al.

[11] Patent Number: 5,305,801

[45] Date of Patent: Apr. 26, 1994

[54] APPARATUS FOR PREPOSITIONING AND DELIVERING HEALD SHAFTS IN LOOMS

[75] Inventors: Fritz Rupflin; Armin Hiemer, both of Lindau, Fed. Rep. of Germany

[73] Assignee: Lindauer Dornier Gesellschaft mbH, Lindau, Fed. Rep. of Germany

[21] Appl. No.: 918,428

[22] Filed: Jul. 22, 1992

[30] Foreign Application Priority Data

Jul. 26, 1991 [DE] Fed. Rep. of Germany ..... 4124797

[51] Int. Cl.[5] ..... D03C 9/00

[52] U.S. Cl. ..... 139/91; 139/1 R; 139/82; 74/89.17

[58] Field of Search ..... 139/82, 91, 92, 1 R; 28/201, 205; 74/89.17

[56] References Cited

U.S. PATENT DOCUMENTS 3,675,686 7/1972 Steiner et al. ..... 139/1 R 4,227,553 10/1980 Schwarz ..... 139/82

5,044,620 9/1991 Ruch et al. ..... 74/89.17 X 5,094,274 3/1992 Bucher et al. ..... 139/82

*Primary Examiner*—Andrew M. Falik

*Attorney, Agent, or Firm*—W. G. Fasse; W. F. Fasse

[57] ABSTRACT

A prepositioning and delivering mechanism for heald shafts is either permanently or temporarily attached to a loom for guiding the heald shafts when a shaft change is to be made. The mechanism has a carrier carrying prepositioning mechanisms each including a rocking lever and a guide roller. These mechanisms are arranged along a longitudinal axis of a journal axle (18) with a spacing that corresponds to a spacing pitch between heald shaft guide frames. Each roller of the prepositioning mechanism is engageable with a respective heald shaft. At least one of the heald shaft guides is engaged with a drive for delivering or advancing of the shaft guides toward the prepositioned heald shafts.

14 Claims, 6 Drawing Sheets

APPARATUS FOR PREPOSITIONING AND DELIVERING HEALD SHAFTS IN LOOMS

FIELD OF THE INVENTION

The invention relates to devices for properly positioning heald shafts in looms to facilitate delivering the heald shafts to respective heald shaft guides.

BACKGROUND INFORMATION

Looms with shaft guides on their side walls arranged to be adjustable back and forth into the loom are known. In such looms up to twenty-eight individual heald shafts are taken up and guided in a vertically slideable manner in individual shaft guides. These shaft guides have a comb-like construction and are horizontally slideable back and forth on axles. It is desirable for the operator of a loom to be able to carry out a rapid shaft change, especially when changing the loom for weaving another article. The replacement of the heald shafts in the individual shaft guides, however, is always especially labor consuming, because during the insertion of the heald shafts into the heald frame, each individual shaft must be aligned to the corresponding shaft guide member of the heald frame and the shaft guide members of the heald frame must be advanced toward the shafts.

The aligning and advancing or delivering is carried out manually which is time consuming.

Therefore, it is not easily possible, during delivery of the shaft guides by hand, to realize the necessary tolerance to be maintained between the shaft guide and the respective heald shaft, by a single delivery operation or by advancing of the shaft guide members. Rather, a manipulation in which the comblike shaft guide members are moved repeatedly back and forth on the axles, is needed in order to bring all the shafts into the corresponding shaft guide members.

OBJECT OF THE INVENTION

Therefore, it is the object of the invention to construct a prepositioning and delivering apparatus that makes possible an easy prepositioning of the individual heald shafts in relation to the corresponding shaft guide members. Further, after the prepositioning of the heald shafts it must be possible to reliably bring the shaft guide members into engagement with the individual heald shafts.

SUMMARY OF THE INVENTION

The invention achieves these objects by an apparatus which is either permanently or temporarily attached to the loom and which comprises a carrier device that has heald shaft prepositioning elements arranged along its length and spaced from one another by a spacing corresponding to the spacing "t" between heald shaft guide members. The heald shaft prepositioning elements are adapted to be brought into meshing cooperation with each heald shaft. At least one of the heald shaft guide members is connected with a drive that causes its delivery or advance to the prepositioned heald shafts.

According to the invention a rapid and safe aligning of the individual heald shafts with the corresponding heald shaft guide members is achieved during a change of heald shafts by an individual shaft guidance, especially during their assembly. As a result, a "two-man assembly" which is an assembly requiring two operators has been avoided. After prepositioning of the heald shafts, the shaft guide members can be advanced toward the heald shafts by the delivering apparatus of the invention. This advancing can be carried out either manually or by machine in a reproduceable manner. An empirical or trial and error and thus time-consuming delivery of the shaft guide members, as known in the prior art, has thus been avoided.

BRIEF DESCRIPTION OF THE DRAWINGS

The invention will be described below in more detail, with reference to the accompanying drawings, wherein.

DETAILED DESCRIPTION OF THE PREFERRED EMBODIMENTS AND OF THE BEST MODE OF THE INVENTION

Figure 1:
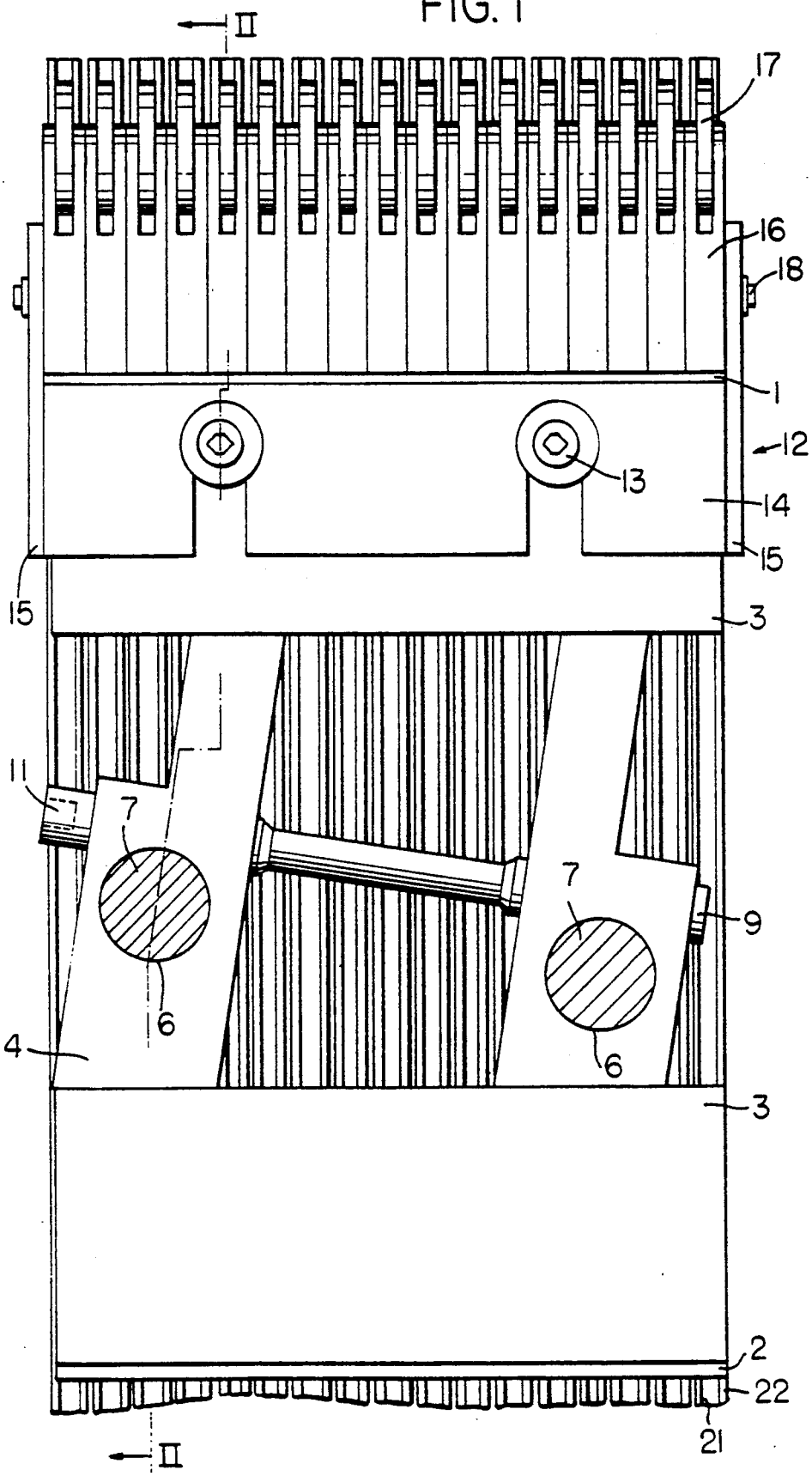
FIG. 1 shows a front view of a prepositioning and delivering device according to the invention.
Figure 2:
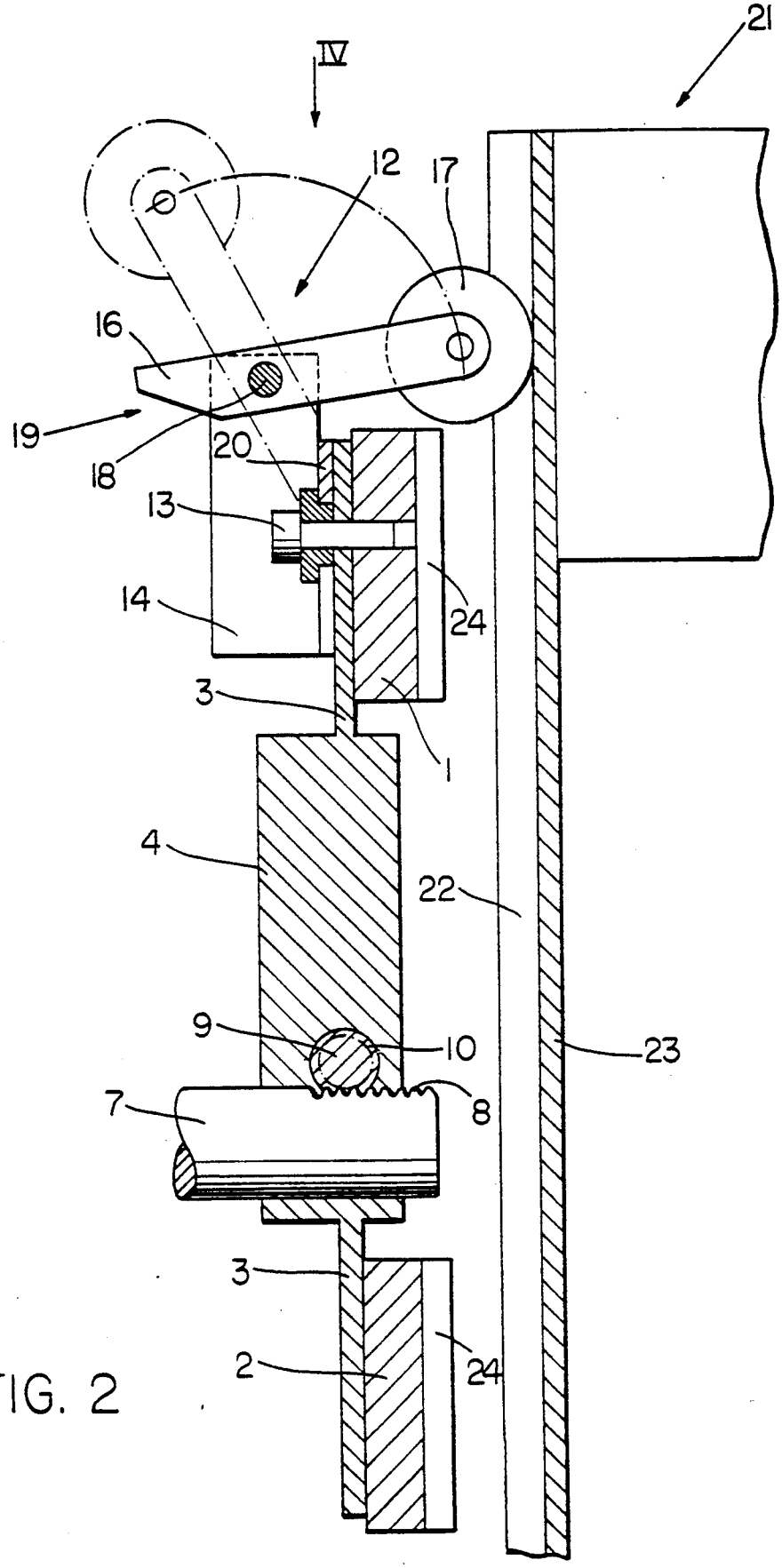
FIG. 2 shows a cross-section along line II—II in FIG. 1 with a heald shaft prepositioned relative to the shaft guide.
Figure 3:
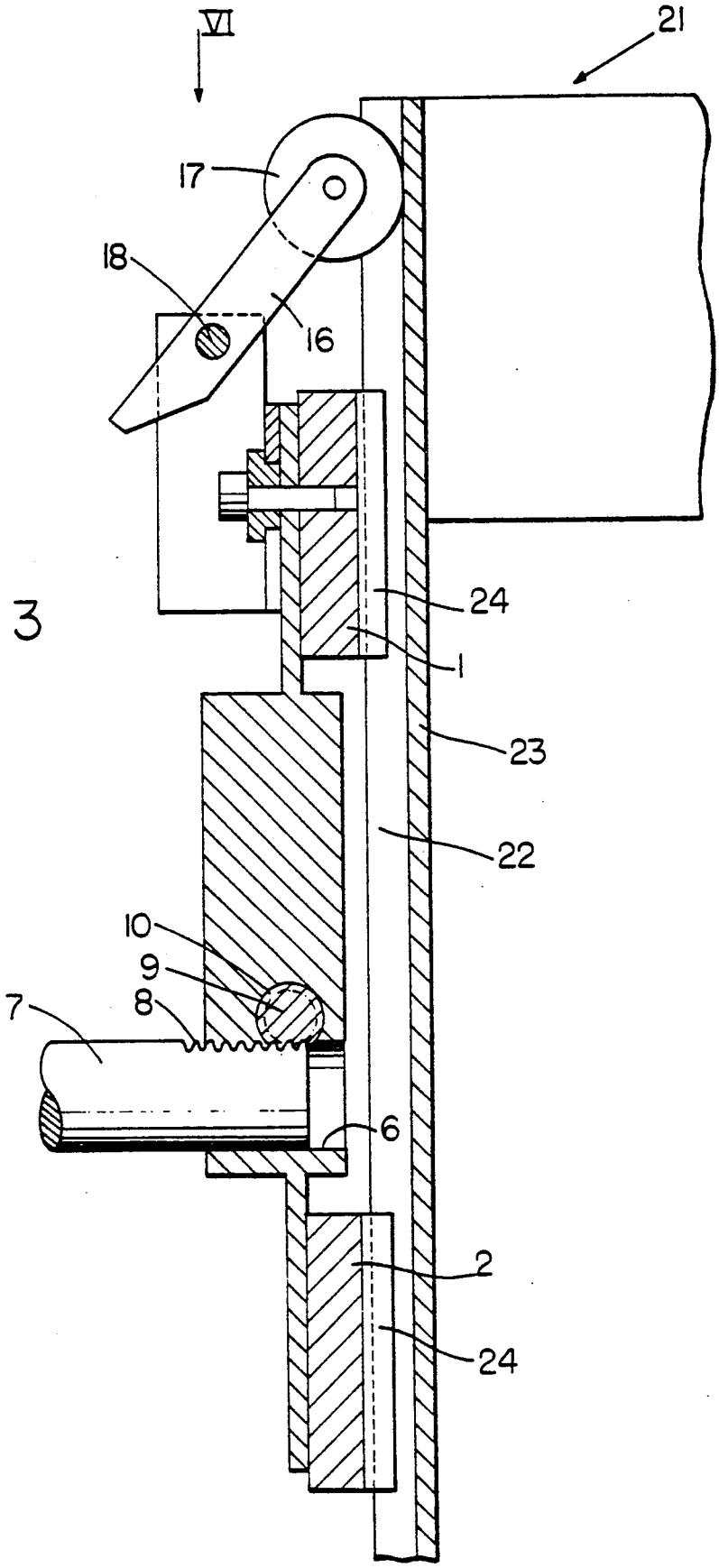
FIG. 3 shows a cross-section along line II—II in FIG. 1, however, now with a heald shaft guide advance onto the respective heald shaft.
Figure 3A:
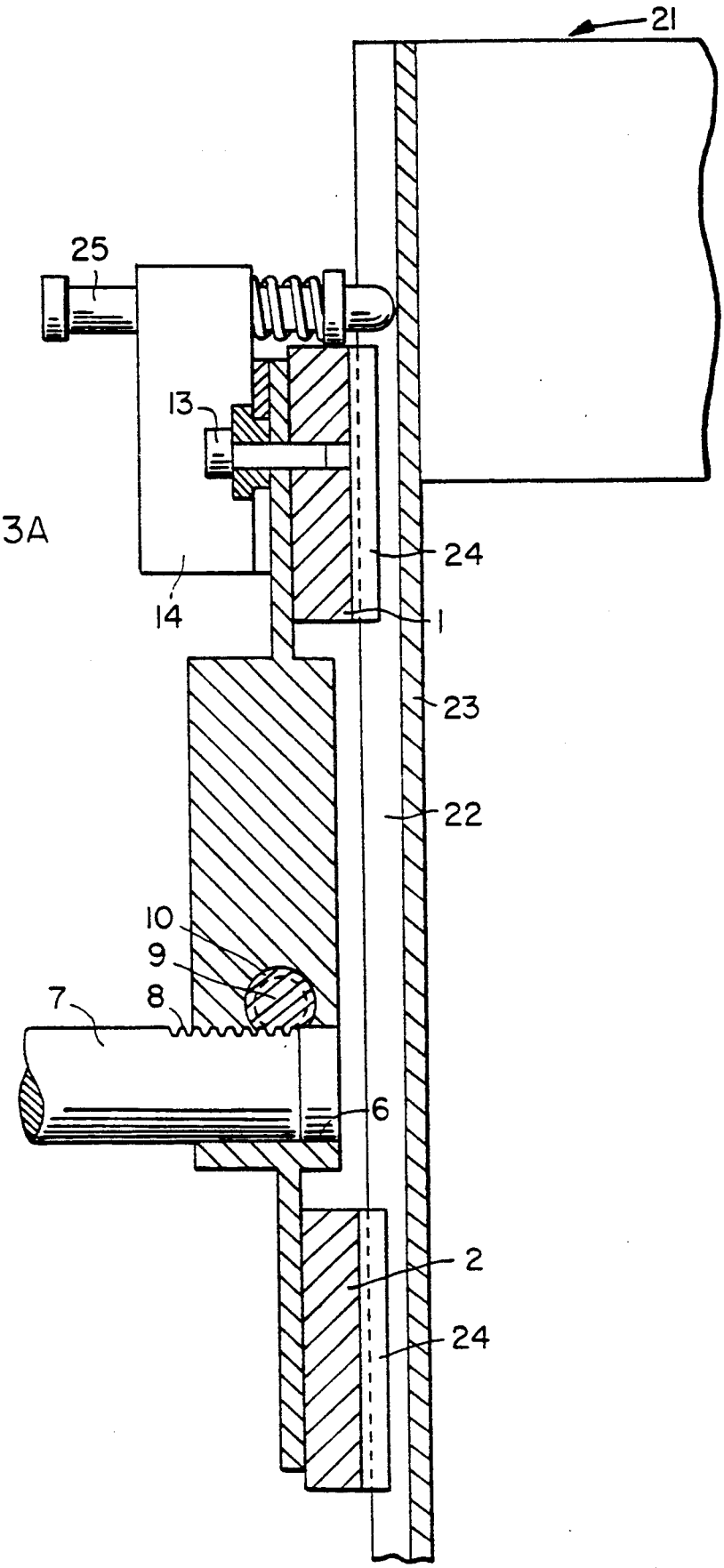
FIG. 3A is a view as in FIG. 3 showing a guide peg instead of a guide roller.

In FIG. 2, an upper shaft guide 1 and a lower shaft guide 2 are depicted. Both shaft guides 1 and 2 are supported by a carrier including mounting plates 3 of a first and a second holder 4, 5 as shown in FIG. 1. The solidly constructed portion of the first and second holder 4, 5 has a through bore 6 constructed as a sliding guide bore. A support axle or shaft 7 is guided in each of these sliding guide bores 6. Both support axles 7 run parallel to each other and are offset vertically in relation to one another on the side walls of the loom, which are not shown. Thus, the support axles 7 form parallel guides for the carrier. One free end of each axle 7 is connected to the side wall. On the other free end each of the axles 7 has teeth 8, as shown in FIGS. 2 and 3. A section of an adjusting or advancing shaft 9 with teeth 10 extends crosswise through the solid portion of the holder 4, 5 above the sliding guide bore 6 of each holder 4, 5. The teeth 10 mesh with the teeth 8 of the axles 7, thereby forming rack and pinion drives. Two such drives are shown in FIG. 1. The adjusting shaft 9 has a hexagonal recess 11 at one end for insertion of a drive tool for rotating the shaft 9 to make an adjustment. While the adjusting shaft 9 is rotated, a displacing movement of the shaft guides 1, 2 follows due to the intermeshing teeth 8, 10 out of one end position continuously in the direction of the individual heald shafts which are propositioned by the prepositioning device 12 still to be described below.

In FIG. 1, the prepositioning device 12 that is either permanently or temporarily attached to the loom, is arranged on the upper mounting plate 3 positioned essentially opposite to the rearward uptake surface of the upper shaft guide 1 and projecting vertically beyond the shaft guide 1.

The prepositioning device 12 comprises a carrier element 14 that is connected by screws 13 to the upper mounting plate 3. The prepositioning device 12 comprises, between side plates 15 on the carrier element 14, a plurality of prepositioning mechanisms each including elements 16, 17 tiltably arranged for swivelling about an axis 18. The prepositioning elements 16, 17 can be swivelled individually or in groups out of the position depicted by the dash-dotted lines, in FIG. 2, into the position depicted by the solid lines. These prepositioning elements 16, 17 comprise a two-armed rocking lever 16 having a prepositioning roller 17 attached to the free end of the rocking lever 16. The rocking levers 16 are mounted for journalling or tilting about the axis 18.

A group swivelling or tilting is accomplished if the lever arm of the rocking lever 16 that carries the positioning roller 17 is, for example, constructed as a multi-tined fork and if each tine carries a positioning roller 17, whereby the number of individual levers would be reduced without causing disadvantages in the prepositioning.

The ends of the axis 18 interconnect both of the side plates 15 of the carrier element 14. Each positioning rocking lever 16 is a double lever 16 with two arms mounted for tilting about the axis 18. One of the lever arms is constructed as an elongated arm carrying the above mentioned positioning roller 17 on its free end. The shorter lever arm comprises a stop face 19 that, as seen in FIG. 2, contacts an impact plate 20 attached between the mounting plate 3 and the carrier element 14.

The positioning elements 16, 17 depicted in the individual figures can also, for example, be constructed as pegs 25 or pins penetrating the carrier element 14 perpendicularly to its longitudinal axis. The pegs 25 or pins are arranged to be slideable individually or in groups.

Figure 4:
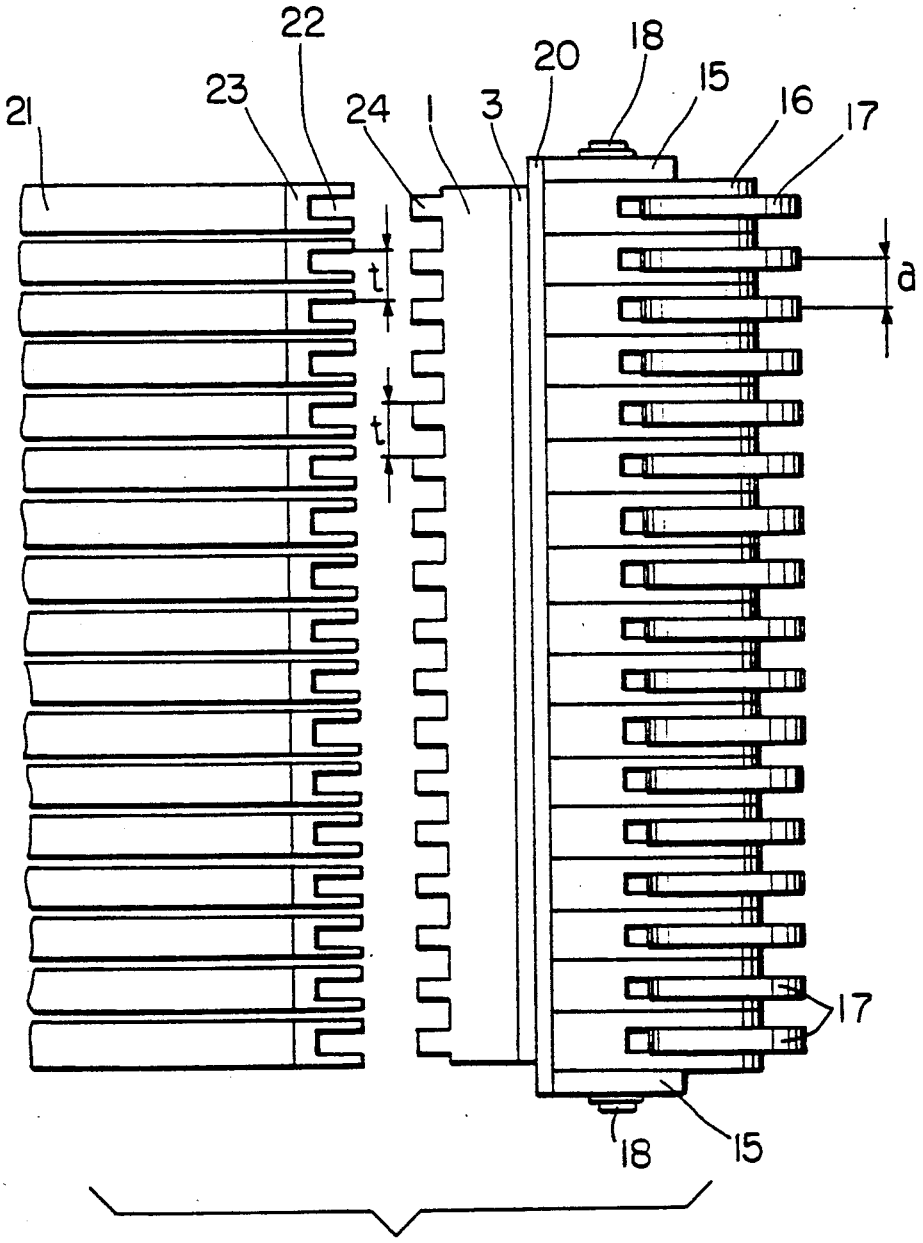
FIG. 4 shows the present prepositioning device viewed in the direction indicated by an arrow IV in FIG. 2 with a positioning element swivelled out.

As shown in FIG. 4, it is important that the positioning or prepositioning elements 16, 17 are spaced from one another in the carrier element 14 by an on-center spacing "a" corresponding to the division or pitch "t" between the individual guide frames or members 24 of the shaft guides 1 and 2. Further, the width of the positioning rollers 17 in the axial direction is smaller than the width of the shaft groove 22 in the heald shafts 21.

FIGS. 2 and 3 illustrate the cooperation of the prepositioning device 12 and the delivering or advancing apparatus with a heald shaft 21. The heald shaft 21 to be prepositioned relative to the upper and lower shaft guides 1, 2 has a shaft groove 22 in its outer, vertical shaft strut 23, into which the guide frames or members 24 of the comb-like shaft guides 1, 2 engage in order to guide said heald shaft (FIG. 3). The individual guide members 24 of the shaft guides 1, 2 are, as described above, attached to the shaft guides 1, 2 with a spacing "t" from one another (FIG. 4).

Figure 6:
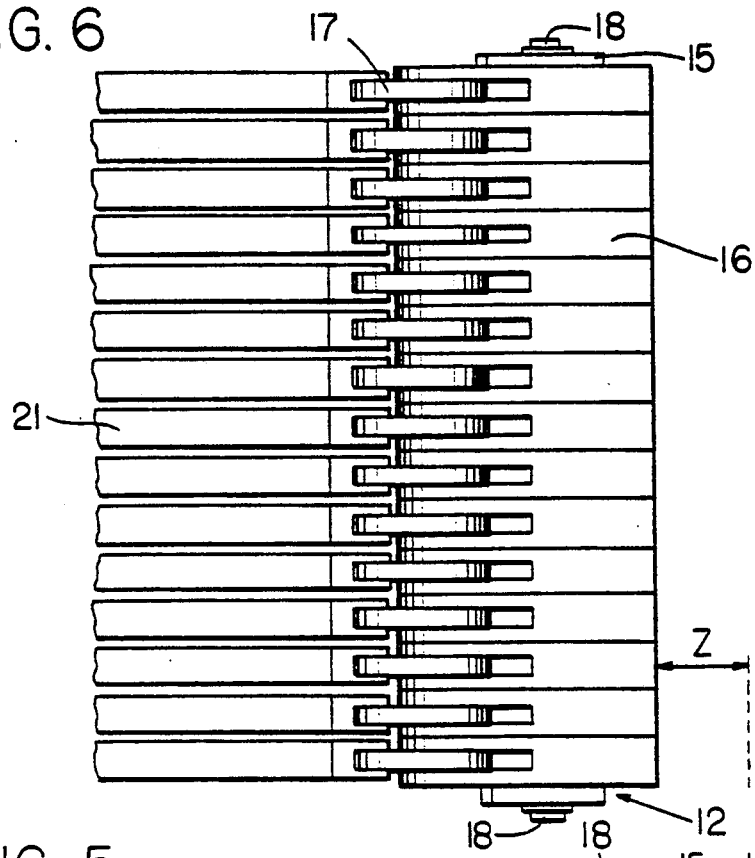
FIG. 6 shows the prepositioning device viewed in the direction indicated by an arrow VI in FIG. 3 with a positioning element swivelled into the shaft groove and with a delivered or advance shaft guide.
Figure 5:
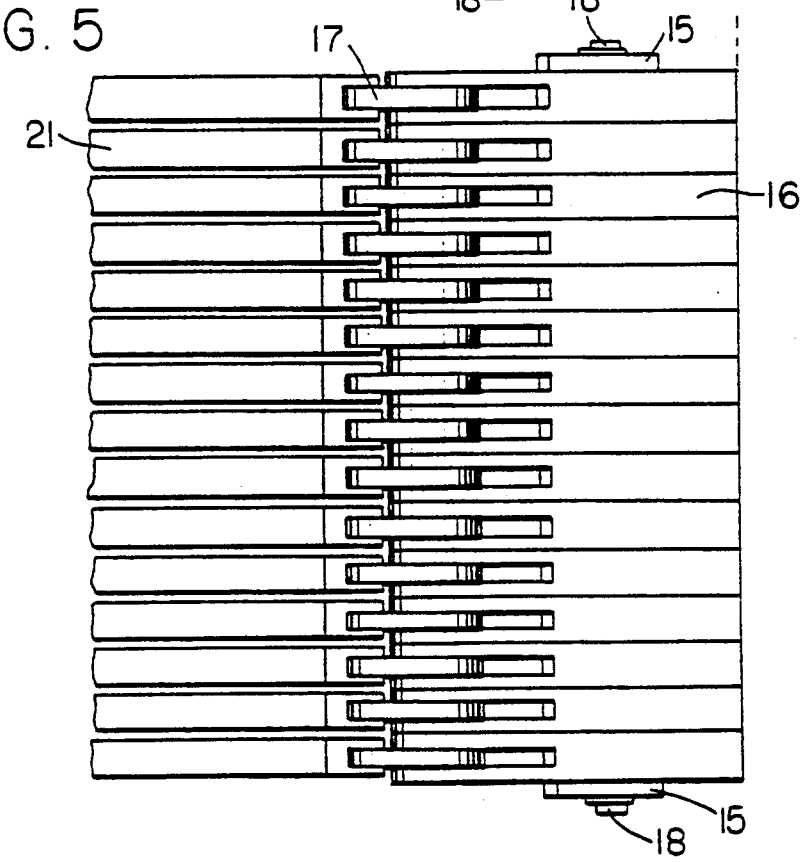
FIG. 5 shows the prepositioning device viewed in the direction indicated by an arrow V in FIG. 2, but now with a positioning element swivelled into the shaft groove.

In FIGS. 4 to 6, the prepositioning and delivery or advancing of the prepositioning device 12 together with the shaft guides 1, 2 are shown in detail. In FIG. 4, the guide frames or members 24 of the upper and lower shaft guides 1, 2 and the shaft groove 22 of the individual heald shafts 21 are arranged opposite one another, and are not engaged. That is, the shaft guides 1, 2 and the prepositioning device 12 are in the back end position on the axle 7. The individual positioning rollers 17 are also in the swivelled out position.

In FIG. 5, the shaft guides 1, 2 and the prepositioning device 12 are still in the back end position on the axle 7, but the positioning elements, that is, the rocking levers 16 and the positioning rollers 17 are tilted into the shaft groove 22 of the corresponding heald shaft 21. Each corresponding heald shaft 21 is thereby prepositioned on the guide frames or members 24 of the shaft guides 1, 2.

FIG. 6 shows, in comparison to FIG. 5, the measure "Z" of the delivery or advance of the shaft guides 1, 2, whereby the prepositioning device 12 is displaced in the direction toward the prepositioned heald shafts 21.

In this illustration of FIG. 6 the individual heald shafts 21 are taken up in the shaft guides 1, 2 and fixed with regard to their further function by the guide members 24 engaged in the respective grooves 22. The prepositioning apparatus can now be removed from its mounting on the loom and can be used as a so-called loom-unattached apparatus for prepositioning in other looms with individual shaft guides.

Although the invention has been described with reference to specific example embodiments it will be appreciated that it is intended to cover all modifications and equivalents within the scope of the appended claims.

We claim:

1. An apparatus for prepositioning and advancing guidable heald shafts (21) in a loom, said apparatus comprising heald shaft guide means (1, 2, 24) adapted for guiding said guidable heald shafts in an operating position, carrier means (4, 14) including a carrier element (14) supporting said heald shaft guide means (1, 2, 24), said heald shaft guide means (1, 2, 24) comprising a plurality of guide rails (24) spaced from each other by a pitch spacing (t), said guide rails (24) being adapted for engaging said guidable heald shafts with said pitch spacing (t) when said guidable heald shafts (21) are in said operating position, said apparatus further comprising prepositioning mechanisms (16, 17) arranged along said carrier element (14) also with said pitch spacing (t) between neighboring prepositioning mechanisms, whereby said prepositioning mechanisms are adapted for engaging each of said guidable heald shafts before said heald shafts are in said operating position to thereby preposition said heald shafts, and drive means (7, 8, 9) connected to said carrier means (4) for advancing said heald shaft guide means (1, 2, 24) toward said prepositioned heald shafts, whereby said heald shaft guide means are adapted for bringing said prepositioned heald shafts into said operating position.

2. The apparatus of claim 1, wherein said carrier means further comprise a journal axle (18), and wherein each of said prepositioning mechanism comprises a rocking level (16) and a prepositioning roller (17) journalled to said rocking lever (16), said journal axle (18) of said carrier means forming a mounting shaft (18) for said rocking lever (16), said carrier means further including mounting plates (15) to which said mounting shaft (18) is secured, said rocking levers (16) being journalled to said mounting shaft (18).

3. The apparatus of claim 2, wherein each rocking lever is individually journalled to said mounting shaft.

4. The apparatus of claim 2, wherein said prepositioning mechanisms are so located on said journal axle (18) of said carrier means (14), that an on-center spacing (a) between neighboring prepositioning mechanisms corresponds to said pitch spacing (t) between individual guide rails (24) of said shaft guide means (1, 2).

5. The apparatus of claim 1, wherein said prepositioning mechanism comprises slideable pegs extending through said carrier element (14) of said carrier means, said slideable pegs being adapted for guidingly engaging said guidable heald shafts (21).

6. The apparatus of claim 1, wherein said drive means connected to said carrier means (4) comprise at least one fixed support axle (7) with teeth (8) on said support axle (7), said teeth (8) extending along a length portion of said support axle (7) corresponding to a length of a feed advance path required for movement between a prepositioning position and said operating position, said drive means further comprising an advancing shaft (9) having teeth (10) meshing with said teeth (8) of said support axle (7) for moving said carrier means (4) relative to said fixed support axle (7).

7. The apparatus of claim 6, wherein said advancing shaft (9) is rotatably mounted in said carrier means (4) to extend crosswise to said fixed support axle (7).

8. The apparatus of claim 6, wherein said teeth (10) of said advancing shaft (9) form a pinion and wherein said teeth (8) of said fixed support axle (7) form a rack, whereby said drive means form a rack and pinion drive.

9. The apparatus of claim 6, comprising two fixed support axles (7) extending in parallel to each other and slidingly through said carrier means (4), each of said fixed support axles (7) having its own section with said teeth (8), said advancing shaft (9) having two gear sections with said teeth (10), each of said gear sections engaging with its teeth (10) respective ones of said teeth (8) on said fixed support axles (7), whereby two rack and pinion drives are formed and said two fixed support axles (7) form a parallel guide for said carrier means (4).

10. A prepositioning apparatus for heald shafts having an on-center pitch spacing (t) between neighboring heald shafts in a loom, comprising a plurality of prepositioning mechanisms, and carrier means for supporting said prepositioning mechanisms, said carrier means including a journal axle (18), each prepositioning mechanism comprising a rocking lever journalled to said journal axle (18) and a prepositioning roller (17) journalled to a free end of said rocking lever (16) for engaging and prepositioning a heald shaft, said prepositioning rollers also having an on-center spacing (a) from each other corresponding to said on-center pitch spacing (t) between neighboring heald shafts.

11. A drive mechanism for a prepositioning device for heald shafts in a loom, comprising carrier means (4) for supporting said prepositioning device, at least one fixed support axle (7) slidingly received in said carrier means, said fixed support axle (7) having a free end with teeth (8) extending along a length portion of said support axle (7) corresponding to a length of a feed advance path required for movement between a prepositioning position and an operating heald shaft guide position of said prepositioning device, said drive mechanism further comprising an advancing shaft (9) having teeth (10) meshing with said teeth (8) of said fixed support axle (7) for moving said carrier means (4) relative to said fixed support axle.

12. The drive mechanism of claim 11, wherein said advancing shaft (9) is rotatable mounted in said carrier means (4) to extend crosswise to said fixed support axle (7).

13. The drive mechanism of claim 11, wherein said teeth (10) of said advancing shaft (9) form a pinion and wherein said teeth (8) of said fixed support axle (7) form a rack, whereby said drive mechanism is a rack and pinion drive.

14. The drive mechanism of claim 11, comprising two fixed support axles (7) extending in parallel to each other and slidingly through said carrier means (4), each of said fixed support axles (7) having its own section with teeth (8), said advancing shaft (9) having two gear sections with teeth (10), each of said gear sections engaging with its teeth (10) respective teeth (8) on said fixed support axles (7) whereby two rack and pinion drives are formed and said two fixed support axles (7) form a parallel guide for said carrier means (4).

* * * * *